US006578585B1

(12) United States Patent
Stachowski et al.

(10) Patent No.: US 6,578,585 B1
(45) Date of Patent: Jun. 17, 2003

(54) BARRETTE

(76) Inventors: Barbara Stachowski, 11 El Gavilan, Orinda, CA (US) 94563; D'Miles Salmon, 33 Tsing King Rd, Tierra Verde Block 2, Flat A, 20/F Tsin Yi Island (HK)

( * ) Notice: Subject to any disclaimer, the term of this patent is extended or adjusted under 35 U.S.C. 154(b) by 8 days.

(21) Appl. No.: 09/792,116

(22) Filed: Feb. 21, 2001

(51) Int. Cl.[7] ..... A45D 8/36
(52) U.S. Cl. ..... 132/273; 24/545
(58) Field of Search ..... 132/273, 156, 132/275, 276, 277, 278, 279; 24/545, 563, 487, 30.5 R; D28/39, 40, 41, 42, 43

(56) References Cited

U.S. PATENT DOCUMENTS 1,338,375 A * 4/1920 Kleidman ..... 24/563
1,480,935 A * 1/1924 Gleason ..... 132/276
3,991,774 A 11/1976 Wolfthal
4,158,902 A 6/1979 Chernack et al.
4,220,248 A 9/1980 Wilson et al.
4,377,247 A 3/1983 Hazard et al.
4,508,124 A 4/1985 Franzino
4,625,898 A 12/1986 Hazard
5,323,793 A * 6/1994 Lorenzi ..... 132/275
5,494,060 A 2/1996 Potut
5,522,407 A 6/1996 Kelsey
5,572,776 A 11/1996 Murphy et al.
5,609,419 A * 3/1997 Byers, Jr. ..... 383/33
5,621,955 A 4/1997 Schmid et al.
5,664,591 A 9/1997 Potut
5,727,576 A * 3/1998 Eren ..... 132/221
5,881,741 A 3/1999 Chen
6,035,863 A 3/2000 Mao
6,050,272 A * 4/2000 Droin ..... 132/273
6,095,155 A * 8/2000 Criscuolo ..... 132/278
6,116,251 A * 9/2000 Stachowski ..... 132/273
6,233,869 B1 * 5/2001 Dearo ..... 24/545
6,234,674 B1 * 5/2001 Byers, Jr. ..... 24/30.5 R
6,257,249 B1 7/2001 Thomas et al.
6,263,884 B1 * 7/2001 Minnelli ..... 132/273
6,267,120 B1 * 7/2001 Serignat ..... 132/273

* cited by examiner

*Primary Examiner*—Eduardo C. Robert
(74) *Attorney, Agent, or Firm*—Haverstock & Owens LLP

(57) ABSTRACT

A barrette structure comprises at least two body sections are attached by their ends through hinge elements. Preferably, a first body section is a semi-rigid bowed structure with an interior concave surface and an exterior convex surface. A second body section is a flexible strip spring member that capable of bowing inward toward the interior concave surface of the first body section with the device in a closed position and outward away from the interior concave surface of the first body section with the device in the open position. With the device in the open position, a section of hair is placed through the opening formed by the first and second body section. The first and second body sections are presses together causing the second body section snap to the closed position securing the section of hair. In accordance with embodiments of the invention, the device is equipped with gripping features which facilitate holding the section of hair between the first and second body section. In further embodiments, the body sections are decorate or colored to have any suitable appearance.

18 Claims, 6 Drawing Sheets

BARRETTE

FIELD OF THE INVENTION

The invention relates to hair styling devices. More specifically, this invention relates to a hair styling devices that hold a selected section or sections of hair.

BACKGROUND OF THE INVENTION

Hair styling often involves manipulating hair into a preferred orientation or style and securing the hair in that preferred orientation or style. This current invention is a device for securing a selected grouping or section or sections of hair in a preferred orientation.

A barrette typically has two sections that clasp together to hold a section of hair. The two section are elongated and attached at one end through a hinge. The other free ends of the barrette typically have elements of a clasp mechanism for securing the free ends together. Hair is placed between the two section and the free end are brought together and secured with the section of hair sandwiched between the two sections. In other barrettes, the two sections are configured to be detached and attached at both ends. Accordingly, hair is placed between the two sections and each end of one section is secured to an end of the other section with the hair sandwiched between the two sections.

SUMMARY OF THE INVENTION

The present invention is an device and method for securing a section or a bundle of hair in a preferred configuration. The device of the present invention has at least two body sections that are hingable attached to each other by at least two hinge sections. The first body section has a interior concave surface. Preferably, the first section is a bowed structure with an interior concave surface and an exterior convex surface. The second body portion is comprised of a flexible member that is attached to the first body section through the hinge sections in at least two positions. The flexible member preferentially bows out from, or inward toward, the interior concave surface of first body section. The device is configured to secure a section of hair between the at least two body sections without detaching the body sections from at the two attached positions.

Preferably, the first body section is an elongated semi-rigid bowed structure and the second body section is an elongated flexible strip spring attached by its ends to the semi-rigid structure, such that the strip spring member snaps between an open bowed position, away form the interior concave surface of the semi-rigid structure, and a closed position, toward the interior concave surface of the semi-rigid structure. Preferably, while moving between the open position and the closed position, the semi-rigid structure passes through a high energy elongated position and the strip-spring remains attached to the semi-rigid structure.

In operation hair is placed between the attached body sections while the first and the second body sections are bowed in opposite directions away from each other forming a opening through which the hair is received. After the hair is placed between the attached body sections, pressing on the first and second body section together causes the second body section to snap to the closed position and bow toward the interior convex surface of the first body section securing the hair between the two body sections.

Preferably the two body sections have substantially similar lengths and are attached to each other at their elongated ends by two hinge elements. The hinge elements are any hinge elements known art, including living hinge elements (i.e. preferred positions of structural inflection) screw hinge elements and pin hinge elements. Pin hinge elements are preferred, wherein, pins are inserted through complimentary overlapping end portions of the first and second body section.

The first and the second body sections are made of any suitable material such a polymeric plastics including nylon plastics and the like. It is preferred that the first body section is semi-rigid or rigid while the second body section is flexible, such that the second body portion is preferentially displaced when the two body sections are presses together.

According to an embodiment of the invention the first and/or the second body section has a gripping element attached to an interior surface to help hold hair between the body sections with the device in a closed portion. The gripping element is a rubber non-slip pad or a surface modification such as protruding teeth structures.

The body sections are decorate or colored to have any suitable appearance. For example, the first body section is covered with cloth, coated with paints, embossed with patterns, embedded decorative elements or coupled with other hair styling devices or any combination thereof. In further embodiments, several strip section are coupled to a larger semi-rigid body section transversely or longitudinally, such that several sections of hair can be secured by a single device, or a section of hair can be secured in more than one position.

DETAILED DESCRIPTION OF THE INVENTION

Figure 1A:
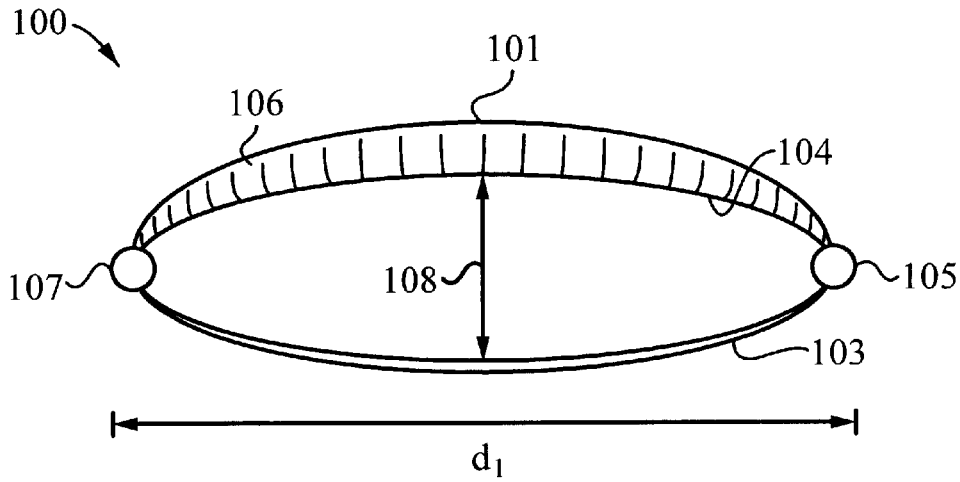
FIGS. 1*a–c* shows a barrette configured to open and close in accordance with the current invention.

FIG. 1*a* illustrates a barrett device 100 in accordance with the instant invention. The barrette device 100 has a first body section 101 that is preferably made of a semi-rigid material such as plastic, rubber, polyurethane, or any other suitable resilient material. The first body section 101 has an interior concave surface 104 and preferably an exterior convex surface 106, however, will be clear to one skill in the art, that exterior surface 106 can be configured with any number of shapes and textures. The barrett device 100 has a second body section 103 that is preferably a strip spring. The strip spring 103 is a thin strip, preferably between 0.5 mm to 3 mm thick. The strip spring is formed any number of flexible and resilient materials, including metals and plastics. In a preferred embodiment of the invention, the strip spring 103 is form nylon.

Still referring to FIG. 1*a*, the semi-rigid body sections 101 and the strip spring 103 are attached to each other from at least two positions 105 and 107. Preferably, the body sections 101 and the strip spring 103 are attached to each other near or at their respective elongated ends through hinge elements 105 and 107. The hinge elements 105 and 107 are any hinge elements known in the art, including living hinge elements and pin-based hinge elements. Embodiments of the invention have a body section 101 that is configured to be larger (longer and/or wider) than the second body section 103.

Figure 1B:
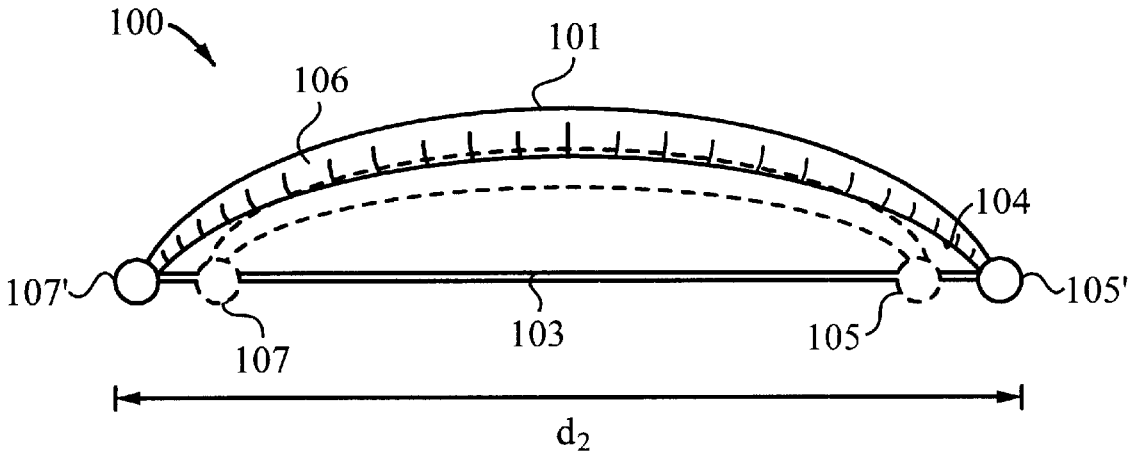
Figure 1C:
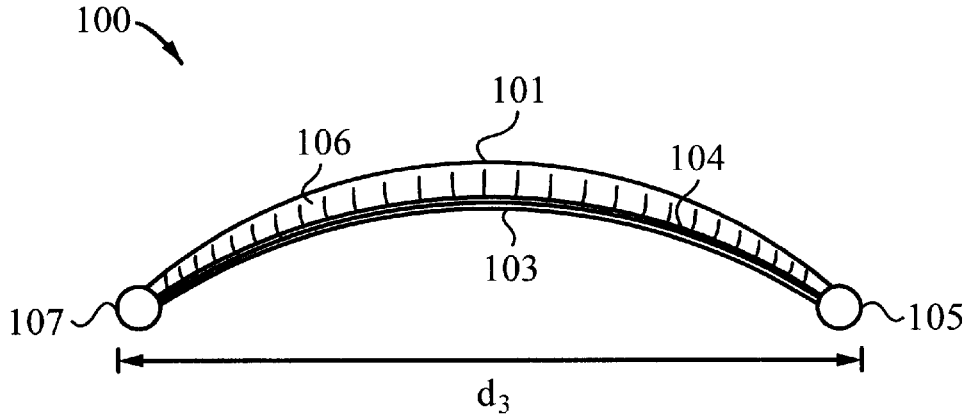

Referring to FIG. 1, with the device 100 in the open position, the semi-rigid body section 101 and the spring strip 103 are bowed in opposite directions 108 to form an opening for receiving a section of hair (not shown). In the open position, the device 100 is elongated by distance $d_1$. Referring now to FIG. 1*b*, squeezing the semi-rigid body section 101 and the spring strip 103 together causes the strip spring to preferentially be displaced toward semi-rigid body section 101 and causes the semi-rigid body section 101 to elongate to a distance $d_2$. As the semi-rigid body section 101 and the strip spring 103 are brought closer together, the strip spring 103 snaps into the closed position and device is elongated by a distance $d_3$, which is substantially similar to the elongated distance $d_1$. In the closed position, such as shown in FIG. 1*c*, the semi-rigid body section 101 and the strip spring 103 are bowed in the same direction and held in this position with sufficient force to hold a section of hair (not shown) between them by virtue of the semi-rigid nature of the body section 101.

Figure 2:
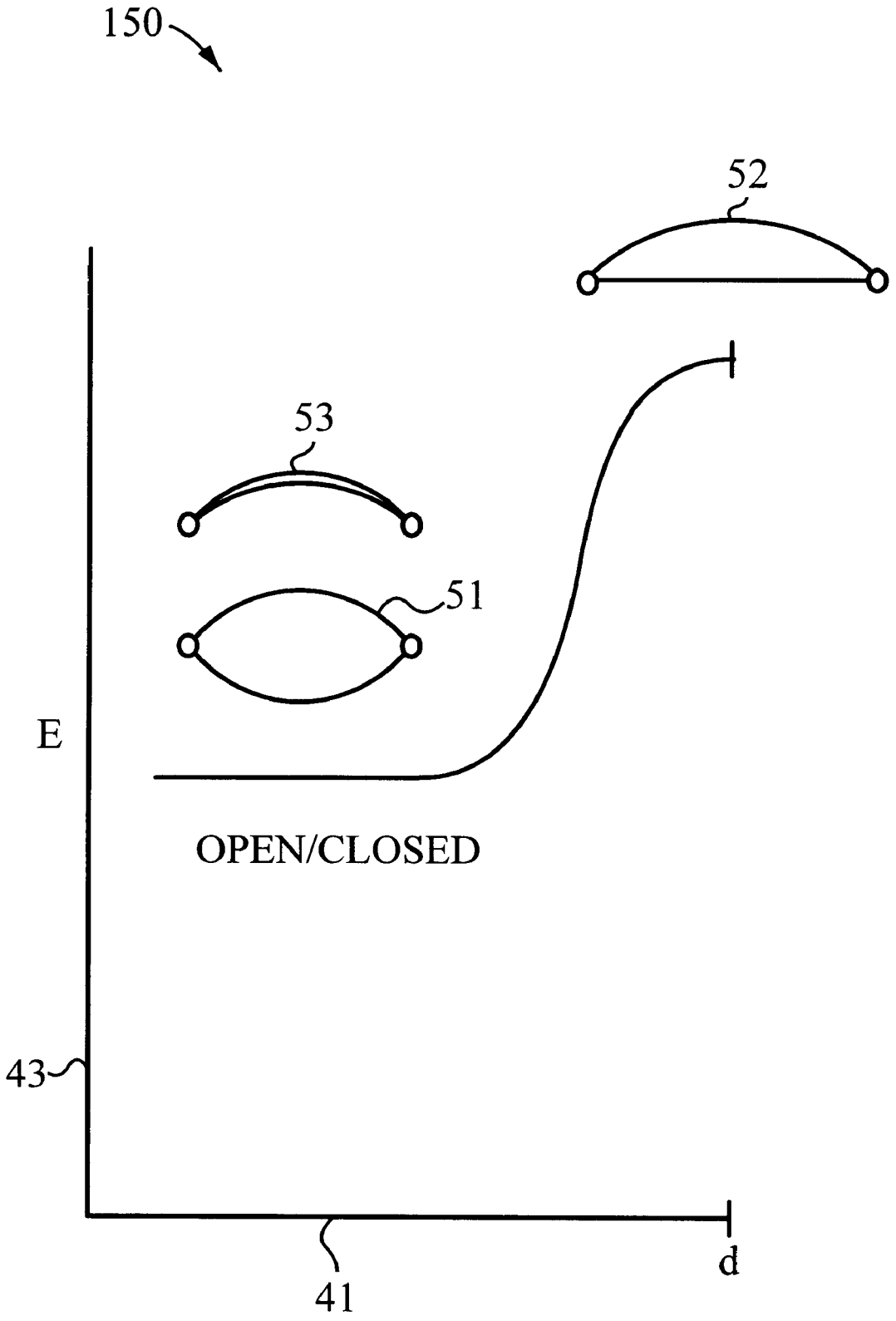
FIG. 2 shows a plot of the potential energy versus the elongation distance while a barrette passes from the open state to the closed state through a high energy elongation state, in accordance with the instant invention.

FIG. 2 illustrates a plot 150 of the potential energy 43 versus the elongation distance 41 of the device 100, as the device 100 passed from the open position 51 to the closed position 53 through an unstable high energy elongated position 52. With the device 100 in the open position 51 the potential energy is low position and the elongation distance 41 is a minimum. As the strip spring 103 is straightened out, the semi-rigid body section 101 is forced to flatten and elongate to the high energy elongated position 52, wherein the elongated distance 41 is at a maximum. In the high energy elongated state 52, pulling the strip spring away form the body section 101 will cause the device 100 snap back into the lower energy open position 51. Alternatively, pushing the strip spring toward the semi-rigid body 101 section will cause the device 100 to snap into the lower energy closed position 53.

Figure 3A:
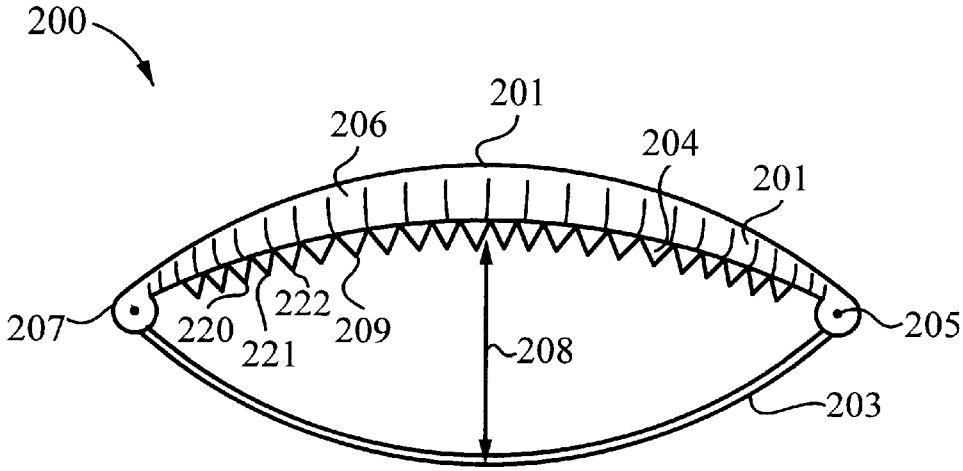
FIG. 3*a* shows a barrette device configured with a griping element for securing hair between the body sections of the barrette device.
Figure 3B:
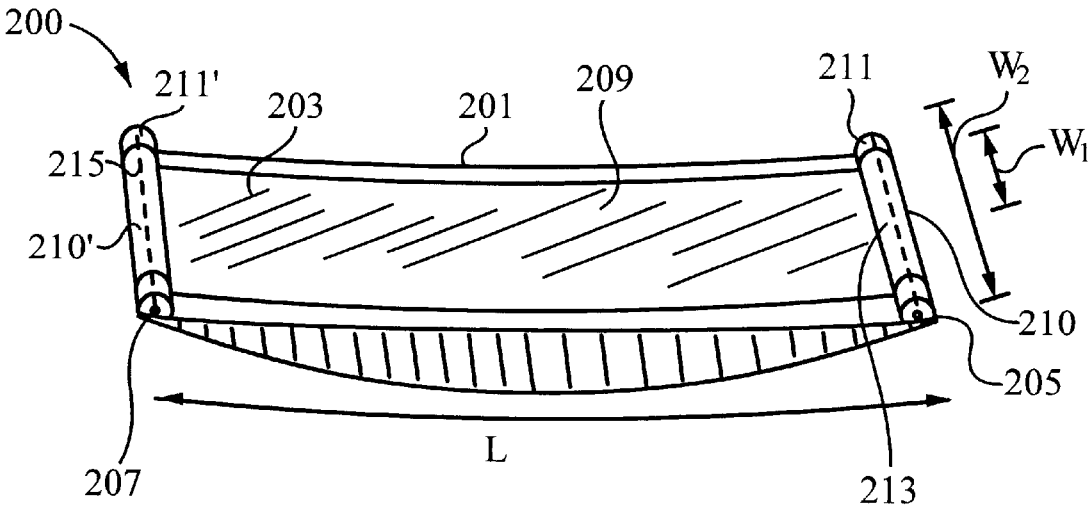
FIG. 3*b* shows a perspective view of the bottom portion of the barrette device illustrated in FIG. 3*a*.

FIGS. 3*a–b* illustrate a barrette device 200 in accordance with a preferred embodiment of the instant invention. The barrette device 200 has a semi-rigid body section 201 and a flexible strip spring 203 that opens and closes by displacing the strip spring through the in the directions indicated by the arrow 208. The concave interior surface 204 preferably has a gripping element 209. Preferably, the gripping element 209 has a plurality teeth structures 220, 221 and 222 that protrude from the interior concave surface 204 of the semi-rigid body section 201. Alternatively, the gripping element is provided through a textured interior concave surface 204 or an non-slip pad made of rubber, or any other suitable material, attached to the interior concave surface 204. Alternatively, the spring strip 203, alone or in combination with the semi-rigid body section 201, is configured with a gripping element (not shown), whereby the gripping element facilitates holding hair between the semi-rigid body section 210 and the strip spring 203 with the device 200 in the closed position.

The semi-rigid body 201 and the strip spring 201 are preferably attached together through two hinge elements 205 and 207. FIG. 3*b*, illustrates a perspective view of the bottom portion of the barrette device 200 shown in FIG. 3*a*, with the device 200 in the 155, closed position. Preferably, the hinge elements 205 and 207 have pins 215 and 213, illustrated by the dotted lines, which pass through complementary interlocking ends 210/210' of the spring strip 203 and interlocking ends 211/21' of the semi-rigid body. Most preferably, the interlocking ends 210 and 210' are configured to have end widths $W_1$ that is smaller than the end widths $W_2$ of the interlocking ends 211 and 211'. Preferably, $W_1$ is between 0.5 and 3 cm and $W_2$ is between 0.75 and 5 cm. While it is preferred that the value of $W_1$ is less than $W_2$ it is understood that the central portion 209 of the strip spring 203 can have any number shapes and configurations. For example, the side of the strip spring 203 are flared or contoured. Further, any number of alternative complicated or simple hinge elements or mechanisms are used to couple the strip spring 203 and the semi-rigid body section 201 together in the manner described herein. The overall length L of the device 200 is preferably between 5 and 12 cm, but it is also understood that the length L may be any size suitable for the application at hand.

Figure 4A:
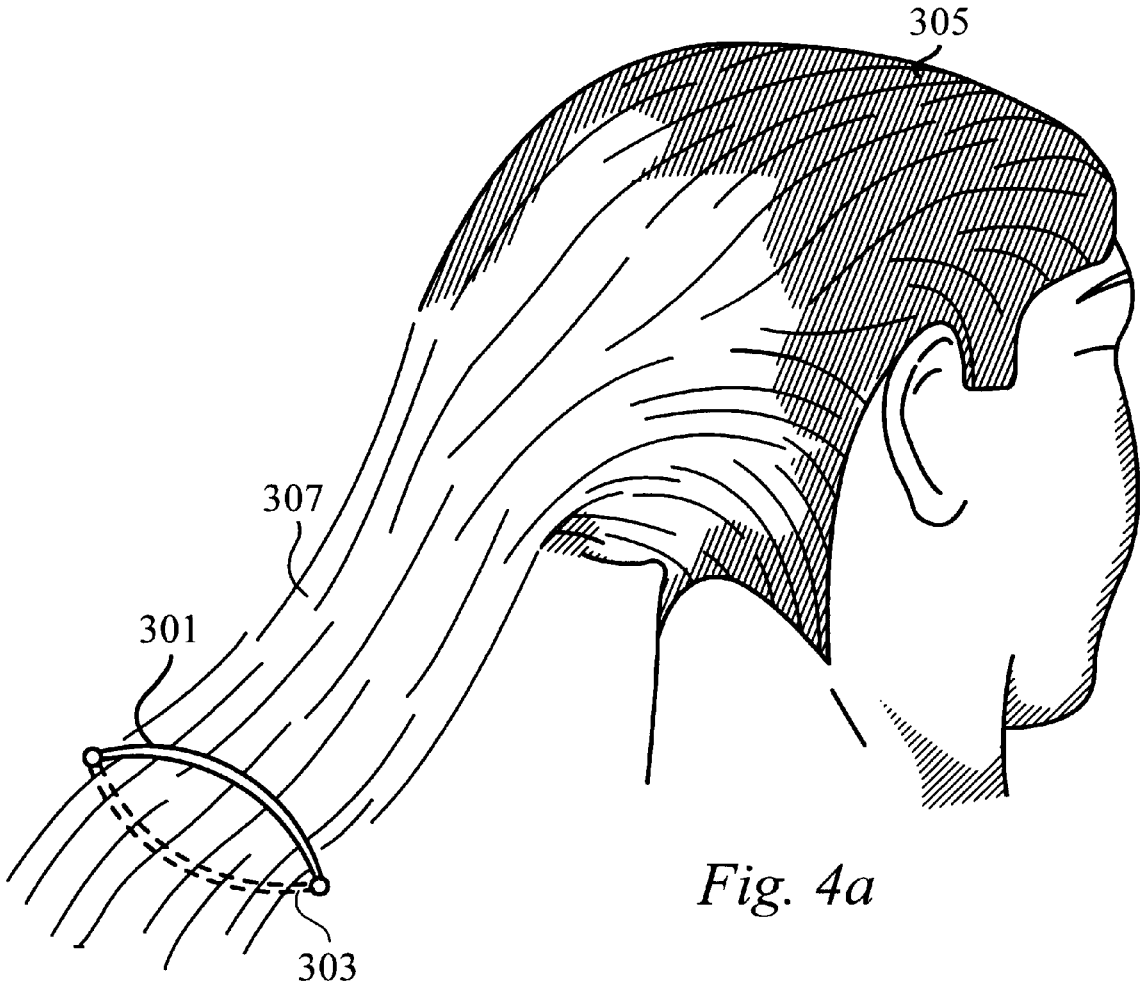
FIGS. 4*a–b* illustrate the method of using the barrette of the instant invention.
Figure 4B:
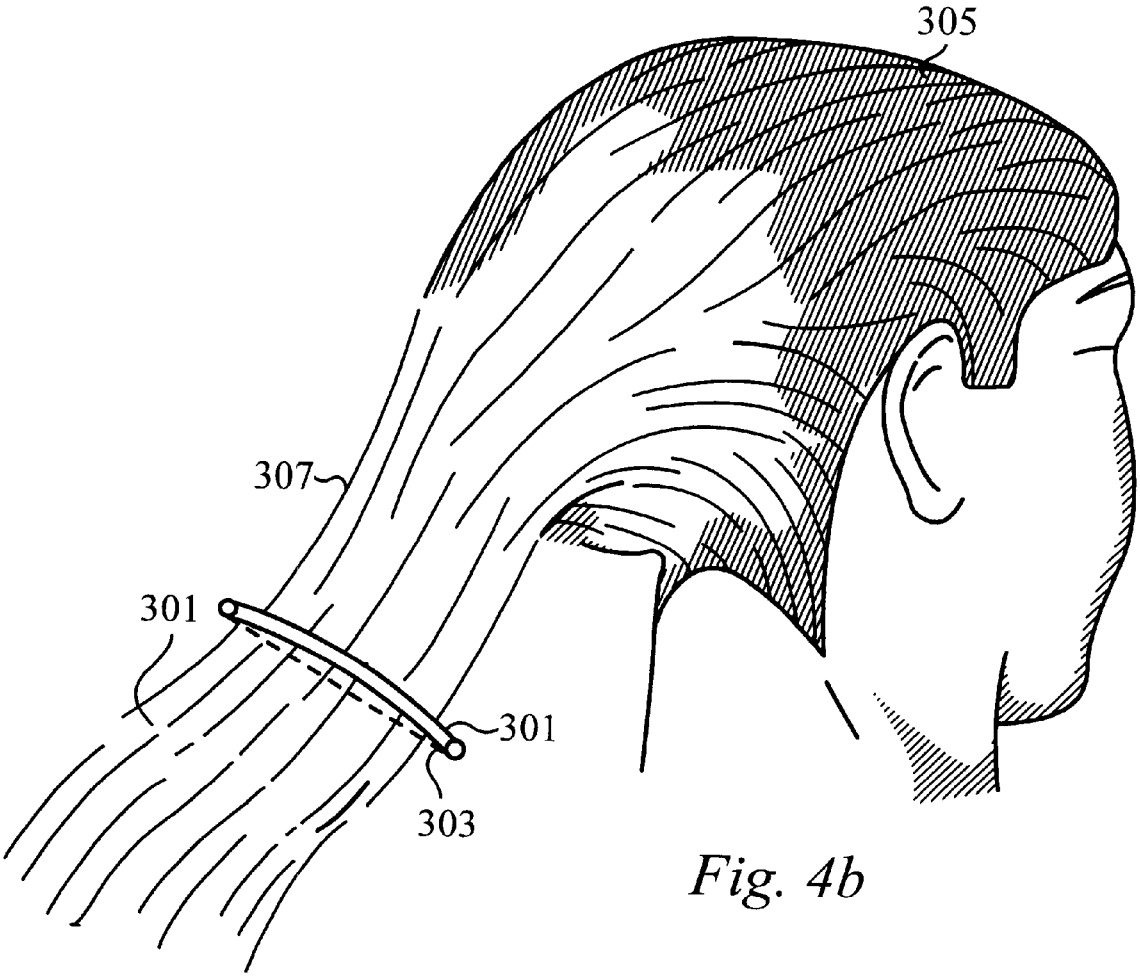

FIGS. 4*a–b* illustrate a method of holding a section 307 of a person's hair 305 utilizing the method of the instant invention. Referring to FIG. 4*a*, a section of hair 307 is placed between a body section 301 and the strip spring 300 of a barrette device. The device is moved along the section of hair to the desired position. Now referring to FIG. 4*b*, once the device is in the desired position the barrette device is place in the closed position to secure the section of hair 307 with the body section 301 and the strip spring 303 bowed in the same direction, as previously described. The device is place in the closed position by applying pressure to body section 310 and the strip spring section 303 such that strip spring 303 snap towards the body section 301 and secures the section of hair 307 between the body section 301 and the strip spring 303.

Figure 5:
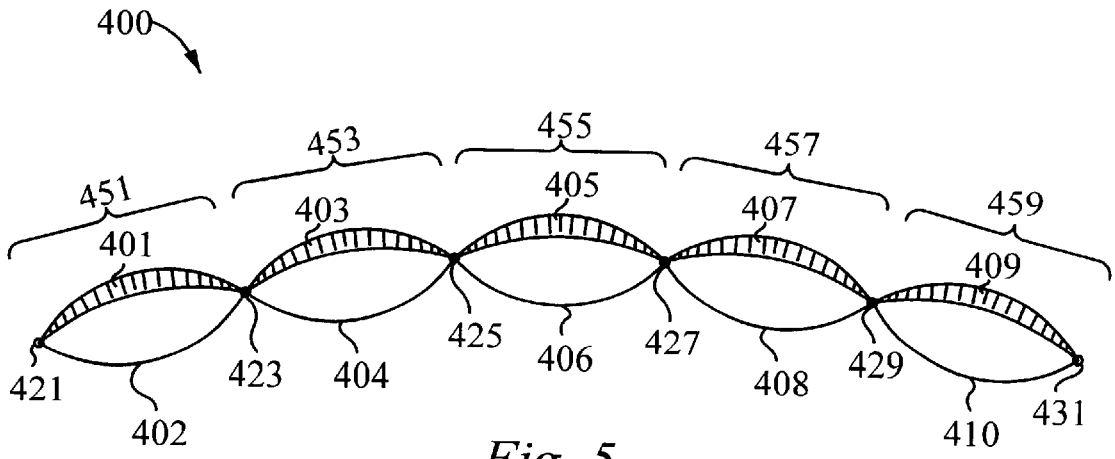
FIG. 5 shows a barrette device with several longitudinal clasping section according to an alternative embodiment of the instant invention.

FIG. 5, illustrates an alterative embodiment of the instant invention. The barrette device 400 is configured with several longitudinally positioned clasping sections 451, 453, 455, 457 and 459 for holding several sections of hair. The device 400 has a plurality of semi-rigid body sections 401, 403, 405, 407 and 407. Each body section 401, 403, 405, 407 and 407 has a corresponding strip spring 402, 404, 406, 408 and 410 coupled to the body sections through hinge elements 421, 423, 425, 427, 429 and 431. Each clasping section 451, 453, 455, 457 and 459 of the device 400 opens and closes independently described to receive a section of chair and to hold the section of hair.

Figure 6:
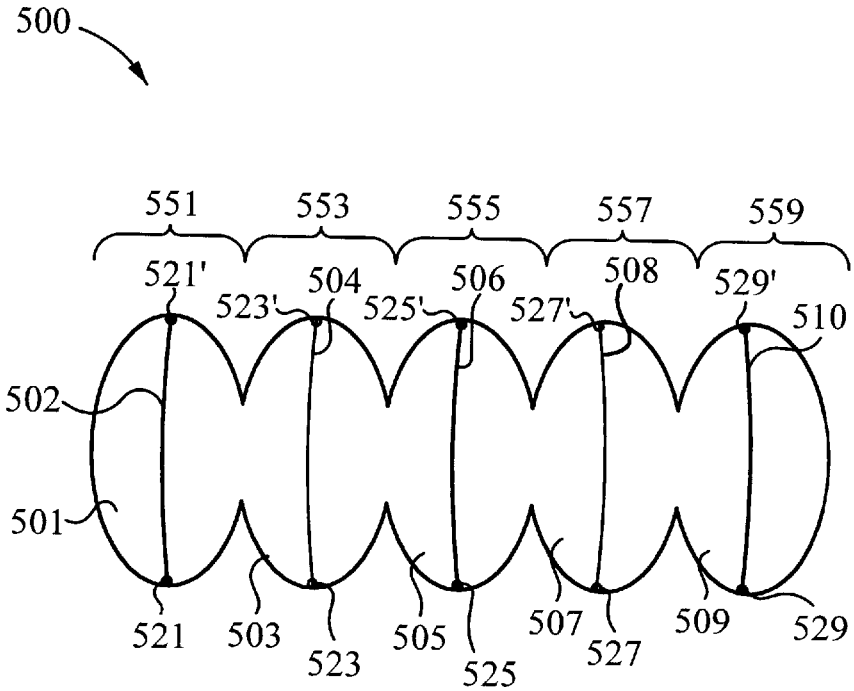
FIG. 6 illustrates a barrette device with several parallel clasping sections in accordance with an alterative embodiment of the instant invention.

FIG. 6 illustrates yet another alternative of the instant invention wherein a barrette device 500 is configured with several traversely portioned clasping sections 551, 553, 555, 557 and 559 for holding a single section of hair at several clasping position along the section of hair. The device 400 has a plurality of semi-rigid body sections 501, 503, 505, 507 and 509. Each body section has a corresponding strip spring 502, 504, 506, 508 and 510 coupled to the body sections 501, 503, 505, 507 and 509 through sets of hinge elements 521/521', 523/523', 525/525', 527/527', 529/529'. Each transversely positioned clasping section 551, 553, 555, 557 and 559 of the device 500 opens and closes independently to receive the section hair in several clasping position on the sections of hair.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and have several different appearances.

What is claimed is:

1. A hair styling device comprising:

a. a semi-rigid bowed structure bowed in a first direction; and b. a flexible structure hingably attached at two attaching positions through pin elements to the semi-rigid bowed structure wherein the flexible structure is capable of bowing in a second direction opposite to the first direction to form an opening between the two attaching positions for receiving a section of hair and wherein the flexible structure is capable of closing to bow in the first direction along with the semi-rigid bowed structure and secure a section of hair therebetween while remaining hingably attached at the two attaching positions.

2. The hair styling device of claim 1, wherein the semi-rigid bowed structure and the flexible structure are elongated structures.

3. The hair styling device of claim 1, wherein the semi-rigid bowed structure and the flexible structure have similar lengths.

4. The hair styling device of claim 3, wherein the attached positions correspond to ends of the semi-rigid bowed structure and the flexible structure.

5. The hair styling device claim 1, wherein at least one of the semi-rigid bowed structure and the flexible structure is formed from a resilient material polymeric material.

6. The hair styling device of claim 1, wherein at least one of the semi-rigid bowed structure and the flexible structure has a griping element for securing the section of hair with the bowed structure and the flexible structure closed.

7. The hair styling device of claim 6, wherein the gripping element comprises protruding teeth structures.

8. A device for holding a section of hair comprising:

a. a bowed semi-rigid structure with a convex surface; and b. a flexible member with a length in an elongated direction, the flexible member being attached by its ends in the elongation direction to at least two attaching positions through pin hinge elements on the bowed structure, wherein the attaching positions are separated by a linear distance less than the length of the flexible member in the elongation direction, such that the flexible member preferentially bows out from the convex surface of the bowed structure with the device in an open position and bows inward toward the convex surface of the bowed structure with the device in a closed position, where in the bowed semi-rigid structure partially straightens as the passes through the open an closed position.

9. The device of claim 8, wherein the semi-rigid bowed structure is elongated with a length in an elongation direction that is substantially similar to the length of the flexible member in the elongation direction.

10. The device of claim 8, wherein the semi-rigid bowed structure is made from a resilient polymeric material.

11. The device of claim 10, wherein the resilient polymeric material is selected from the group consisting of rubber plastic and polyurethane.

12. The device of claim 8, wherein the semi-rigid bowed structure is configured with a gripping element to secure the device to a section of hair while the device is in the closed position.

13. The device of claim 12, wherein the gripping element comprises teeth elements protruding from the convex surface of the bowed structure.

14. The device of claim 8, wherein the flexible structure is configured with a gripping element to secure the device to a section of hair while the device is in the closed position.

15. The device of claim 8, wherein the flexible structure is formed from nylon.

16. A method for holding a section of hair comprising the steps of:

a. placing the sections of hair between a first elongated member and a second elongated member that are separated and bowing away from each other, the first elongated member and the second elongated member being hingably attached near their ends, wherein the first elongated member is substantially more rigid than second elongated member; and b. pressing on the second elongated member with the section of hair between the first and the second elongated member such that the second elongated member bows in substantially the same direction at the first elongated member, thereby gripping the section of hair while the first elongated member and a second elongated member remain hingably attached.

17. A device for holding a section of hair comprising;

a. an elongated semi-rigid structure with a convex surface and a concave surface;

b. an elongated flexible strip spring member attached by its ends through pin hinge elements to elongated semi-rigid structure wherein the elongated flexible strip spring member snaps between an open bowed position away from the convex surface of the semi-rigid structure and a closed bowed position toward the convex surface of the semi-rigid.

18. A device for holding a section of hair comprising:

a. a semi-rigid section means;

b. a flexible section means; and c. means to attach the semi-rigid section and the flexible section means at two positions through pin hinge elements such that the semi-rigid section and flexible section means are capable of being opened for receiving hair and closed for securing the section of hair without separating the semi-rigid section and the flexible section means at the two positions.

* * * * *

UNITED STATES PATENT AND TRADEMARK OFFICE

CERTIFICATE OF CORRECTION

PATENT NO. : 6,578,585 B1
DATED : June 25, 2003
INVENTOR(S) : Barbara Stachowski et al.

It is certified that error appears in the above-identified patent and that said Letters Patent is hereby corrected as shown below:

Column 5,
Line 57, replace “where in” with -- wherein --.
Line 58, between “the” and “passes” insert -- section of hair --.
Line 59, replace “an” with -- and --.

Signed and Sealed this

Twelfth Day of August, 2003

JAMES E. ROGAN
*Director of the United States Patent and Trademark Office*